US005641172A

United States Patent [19]

Hoffman et al.

[11] Patent Number: 5,641,172

[45] Date of Patent: Jun. 24, 1997

[54] SKATE BOARD

[76] Inventors: Martin W. Hoffman; Ruth M. Hoffman, both of 707 Cordova St., San Diego, Calif. 92107

[21] Appl. No.: 413,183

[22] Filed: Mar. 30, 1995

[51] Int. Cl.[6] ..... A63C 17/00

[52] U.S. Cl. ..... 280/87.042; 280/11.3

[58] Field of Search ..... 280/11.3, 613, 280/842, 87.042, 14.2

[56] References Cited

U.S. PATENT DOCUMENTS 4,133,546 1/1979 Rosenblum ..... 280/87.042

5,090,722 2/1992 Richie et al. ..... 280/607

5,544,919 8/1996 Tinkler ..... 280/87.042

FOREIGN PATENT DOCUMENTS 1075477 9/1996 WIPO ..... 280/87.042

*Primary Examiner*—Richard M. Camby

*Attorney, Agent, or Firm*—Henri J. A. Charmasson; John D. Buchaca

[57] ABSTRACT

A skating device comprises an oblong platform, having curled-up front and end sections, mounted on roller assemblies and having a first boot fixedly secured at a right angle on top of the front end section and a second boot pivotally secured above a rear portion of the platform.

9 Claims, 1 Drawing Sheet

SKATE BOARD

FIELD OF THE INVENTION

This invention relates to skating devices, and more particularly to skate boards.

BACKGROUND OF THE INVENTION

Skate boarding began as a child's recreational activity, and has now graduated to a full-fledged competitive sport with related acrobatic exhibitions and artistic performances not unlike ice skating.

At the core of skate boarding is the skaters ability to change his position on the skate board, vary his footwork, and his contacts with various parts of the board. When performing acrobatics, the lack of fixed attachment between the skate board platform and the user's footwear substantially restricts the scope of those acrobatics. For instance, the user may be forced to grab both ends of the platform with his hands when airborne to maintain foot contact. On the other hand, attaching the skater's footwear to the board would seriously limit the range of skateboarding activities.

The invention results from a search for an acceptable compromise between the conventional skate board and the method adopted in the sport of snow boarding where the user's boots are fixedly and permanently attached to the top of the snow board.

SUMMARY OF THE INVENTION

The principal and secondary objects of this invention are to provide a new type of skate board wherein a permanent contact is maintained between the top surface of the skate board and the user's footwear in order to broaden the acrobatic capabilities of the board, and at the same time maintain a certain freedom of footwork movements.

These and other objects are achieved by permanently attaching the user's boots on the top of the skate board in a manner allowing pivotal movement of at least one foot.

DESCRIPTION OF THE PREFERRED EMBODIMENT OF THE INVENTION

Figure 1:
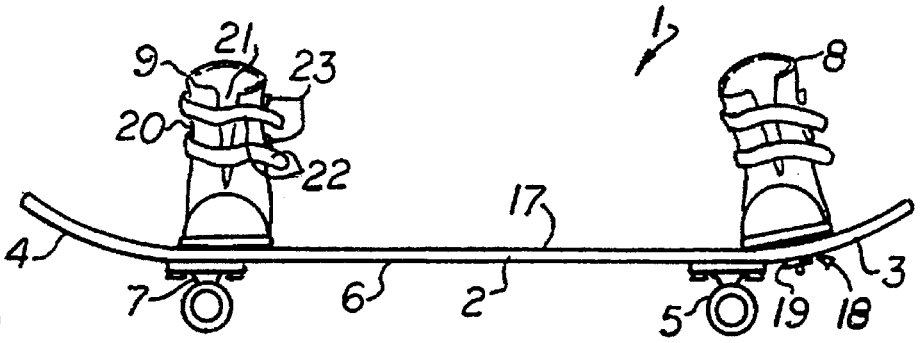
FIG. 1 is a side elevational view of a skating device according to the invention.
Figure 2:
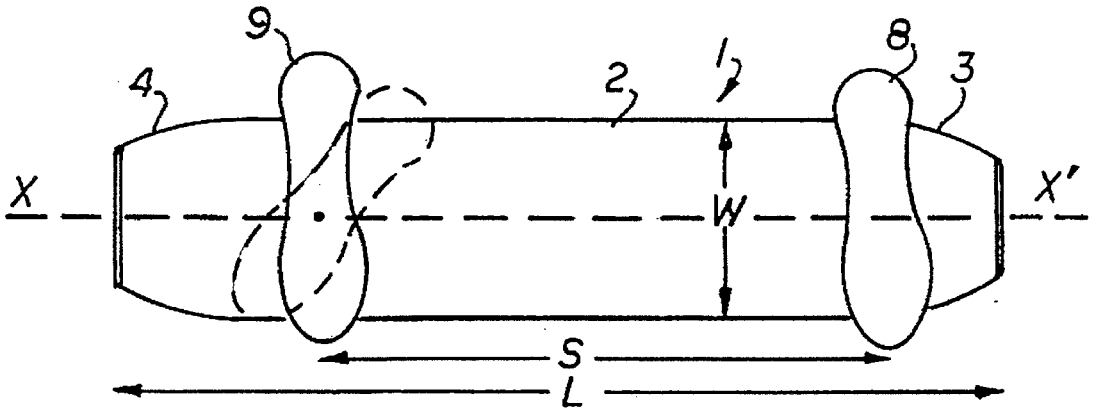
FIG. 2 is a diagrammatical top plan view of the positioning of the footwear over the skate board platform.

Referring now to the drawing, there is shown a skating device 1 comprising an oblong platform 2 having a frontal end section 3 and a tail end section 4 which are arcuately bent upward. The platform is mounted on a pair of roller assemblies of which the frontal one 5 is secured to the bottom surface 6 of the platform just behind the curled-up front end section 3. Similarly, the posterial roller assembly 7 is secured to the bottom surface of the platform just ahead of the curled-up tail end section 4. The roller assemblies 5, 7 are symmetrically lined up on the longitudinal axis X—X' of the platform.

Figure 3:
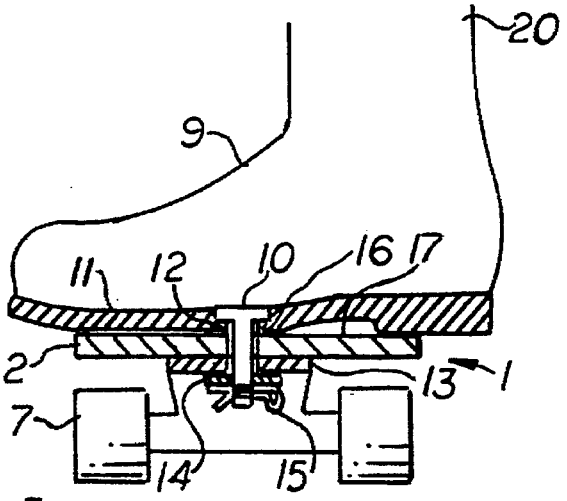
FIG. 3 is a cross-sectional view of the pivotal attachment of one of the boots.

A first boot 8 is fixedly mounted at right angle across the longitudinal axis X—X' on the top surface of the platform and in the arcuate front end section 3. A second boot 9 is mounted on the top surface of the platform substantially above the posterial roller assembly, but in a pivotally adjustable position. As more specifically illustrated in FIG. 3, a pivot pin 10 passes through a median section of the boot sole 11, through a platform hole 12 bored on the longitudinal axis X—X' then through a mounting section 13 of the posterial roller assembly 7 before being secured by a washer 14 and cotter pin 15. An additional washer 16 sandwiched between the sole 11, the boot and top surface 17 of the platform facilitates the rotating movement of the boot 9 over the platform. A nearly similar securing assembly 18 is used to attach the first boot 8 to the platform. However, in this case, the cotter pin 15 is replaced by a nut 19 which is tightened to fixedly position the boot 8 in a transversal arrangement above the top surface of the platform.

It should be understood that in order to perform certain maneuvers, it might be advantageous to allow a certain range of pivotal movement of the first boot 8 in relation to the board by replacing the tightening nut 19 with a looser type of fastener.

The overall length of the board L ranges preferably between 50 and 100 centimeters (20 and 40 inches). Its width W can vary from 10 centimeters to 20 centimeters (4 to 10 inches). The spacing S between the securing points of the boots preferably ranges from 45 centimeters to 60 centimeters (18 to 24 inches) depending upon the size of the user.

Each boot 8, 9 is made from molded semi-rigid or rigid sheet material not unlike the one used in making ice skate boots or ski boots, and has an upper portion 20 that extends upwardly to cover the ankle of the wearer. The opening 21 in the frontal part of the upper section can be closed and cinched by a series of straps 22 and buckle assemblies 23 to provide a firm support of the ankle articulation.

While the preferred embodiments of the invention have been described, modifications can be made and other embodiments may be devised without departing from the spirit of the invention and the scope of the appended claims.

What is claimed is:

1. A skating device which comprises:

an oblong platform having a top surface, a bottom surface, a longitudinal axis, a front end section, and a tail end section;

a pair of roller assemblies lined up on said axis, a frontal one of said assemblies being secured to said bottom surface proximate said front end section, and a posterial one of said assemblies being secured to said bottom surface proximate said tail end section;

a first boot permanently mounted at a substantially right angle across said axis on said top surface in said front end section; and a second boot permanently pivotally secured to said top surface proximate said tail end section;

wherein each of said boots comprises a rigid sole and an upper section shaped and dimensioned to enclose a wearer's ankle, and made of molded rigid sheet material.

2. The device of claim 1, wherein said front end section is bent arcuately upward.

3. The device of claim 1, wherein said boots are spaced apart by a distance ranging from 45 centimeters to 60 centimeters (18 inches to 24 inches).

4. The device of claim 3, wherein said platform has a length between 50 centimeters and 100 centimeters (20 inches and 40 inches).

5. The device of claim 3, wherein said second boot is secured to said surface substantially above said posterial roller assembly.

6. The device of claim 3, wherein said first boot is secured to said top surface forwardly from said frontal assembly.

7. The device of claim 6, wherein said first boot is fixedly secured to said top surface.

8. The device of claim 7, wherein said second boot comprises means for pivotally securing a median sole section of said boot to a point of said top surface along said axis.

9. The device of claim 8, wherein said tail end section is bent arcuately upward.

* * * * *